US007591731B2

(12) United States Patent
Carroll

(10) Patent No.: US 7,591,731 B2
(45) Date of Patent: Sep. 22, 2009

(54) PROPOSED RUNNING TRACK DESIGN FOR FAIRER 200 M AND 400 M RACES

(75) Inventor: Michael M. Carroll, Missouri City, TX (US)

(73) Assignee: AlphaDev LLC, Houston, TX (US)

( * ) Notice: Subject to any disclaimer, the term of this patent is extended or adjusted under 35 U.S.C. 154(b) by 110 days.

(21) Appl. No.: 11/564,019

(22) Filed: Nov. 28, 2006

(65) Prior Publication Data

US 2007/0123360 A1 May 31, 2007

Related U.S. Application Data

(60) Provisional application No. 60/740,263, filed on Nov. 29, 2005.

(51) Int. Cl.
*A63K 1/00* (2006.01)
*A63K 3/00* (2006.01)

(52) U.S. Cl. ..... 472/85; 472/92; 473/415

(58) Field of Classification Search ..... 472/85–87, 472/92; 273/246; 473/415, 470, 471
See application file for complete search history.

(56) References Cited

U.S. PATENT DOCUMENTS 2,036,630 A * 4/1936 Hastings ..... 273/246
2,351,707 A * 6/1944 Rouprich ..... 324/178
4,128,241 A * 12/1978 Morera ..... 273/246

OTHER PUBLICATIONS

1 Page of Track Lane Distance Calculator from www.johnscabin.com.*
Supplemental International Search Report issued during the prosecution of International Application No. PCT/US06/45674.

* cited by examiner

*Primary Examiner*—Kien T Nguyen
(74) *Attorney, Agent, or Firm*—Fulbright & Jaworski L.L.P.

(57) ABSTRACT

The present invention is directed to a system and method for conducting a more fair race around an oval track by having runners in each lane run equal arc angles. Such a configuration eliminates the disproportionate effect of centrifugal force on competitors running in different lanes. Embodiments of the invention provide for the addition of a straight section to a standard oval track extending from a curved section perpendicular to the existing straightaway section. Runners in each lane start at staggered locations on the straight section. The staggered starting locations are chosen such that each runner travels an equal distance from the starting location to a common finish line. A single straight section may be employed to conduct races covering the entire length and half the length of the oval track or two straight sections may be employed to allow finishes for both races at a common finish line.

22 Claims, 6 Drawing Sheets

$$F\cos\theta = \frac{dv}{dt} + \beta v^2$$

$$F\sin\theta = \frac{v^1}{v_n}$$

PROPOSED RUNNING TRACK DESIGN FOR FAIRER 200 M AND 400 M RACES

CROSS-REFERENCE TO RELATED APPLICATIONS

The present application claims priority to U.S. Provisional Application Ser. No. 60/740,263, filed Nov. 29, 2005, the entirety of which is hereby incorporated by reference.

TECHNICAL FIELD

The present invention relates to the field of race course design.

BACKGROUND OF THE INVENTION

Several sporting events involve competitors racing around an oval track consisting of two straightaway portions and two curved portions connecting the straightaway portions. FIG. 1A illustrates a traditional track 10 with straightaway portions extending from point 101 to 106 and point 103 to 104 and curved portions extending from point 101 to 102 to 103 and point 104 to 105 to 106. A traditional track 10 often includes several parallel lanes where lane 1 is the innermost lane. FIG. 1B shows a portion of track 10 extending from point 106 to 101 to 102. As can be seen in FIG. 1B, track 10 includes of 8 parallel lanes 131-138. In several events utilizing track 10, each competitor must stay within his or her assigned lane. At least twelve Olympic events require competitors to stay within an assigned lane: the 200 m and 400 m, the 400 m hurdles, the 4×100 m relay, the 4×400 m relay (first leg) and the decathlon, for men and for women. The arc length of an outer lane is greater than that of an inner lane. Thus, in order for each competitor to run the same length and yet finish at a common finish line, the competitors are placed in staggered starting position, for example, on the first curve between points 101 and 103 such that each competitor runs equal arc lengths before reaching the straightaway.

Despite this "staggered start" positioning that equalizes the distance run by each competitor, a serious lack of parity between competitors in track events remains. This lack of parity stems from the "centrifugal effect." An athlete running a curve must expend some of his or her thrust force to combat the centrifugal force, leaving less thrust force available for increasing or maintaining speed. Consequently, he or she can run faster on a straight course than on a curve. More importantly, he or she can run faster in an outer (less curved) lane than in an inner lane. The importance of this effect is indicated by the fact that Tommy Smith's world record time for the conventional 200 m, which he set running in Lane 3 , is 0.43 sec slower than his world record time for a 200 m run in a straight track.

A 200 m straight track may be constructed by adding a 100 m extension onto the straightaway extending from point 103 to 104 of FIG. 1A. Such a 100 m extension may prove problematic within a track venue as it may not fit within the playing surface and may result in inferior sightlines for spectators.

BRIEF SUMMARY OF THE INVENTION

The present invention is directed to a system and method for conducting a more fair race around an oval track by configuring the track such that the runner in each lane runs an arc angle equal to the runners in other lanes. Such a configuration eliminates the disproportionate effect of centrifugal force on competitors running in inner lanes. Embodiments of the invention provide for the addition of a straight section to a standard oval track extending from the midpoint of a curved section and perpendicular to the existing straightaway section. Runners in each lane start at staggered locations on the straight section and proceed through a curved quadrant and to a finish line on the straightaway furthest away from the straight section. The staggered starting locations are chosen such that the runner in each lane travels an equal distance from the starting location to a common finish line on the straightaway. The straight section may have a rectangular shape in some embodiments or may be angled to accommodate the staggered starting positions such that the straight section extends further at lane 1 than at the outer lane.

In another embodiment, runners in each lane start at staggered locations on the straight section and proceed through a curved quadrant, the straightaway furthest away from the straight section, a curved semi-circular section, and then to a finish line on the straightaway closest to the straight section. Once again, staggered starting locations are chosen such that the runner in each lane travels an equal distance from the starting location to a common finish line on the straightaway. In one embodiment, the track may have straight sections extending from each curved section perpendicular to the straightaway sections and in opposite directions of each other such that a race covering half of the length of the oval track may be started from the first straight section and a race covering the entire length of the oval track may be started from the second straight section and both races may utilize a common finish line. In another embodiment, the track may have a single straight section such that races covering half the length of the oval track and races covering the entire length of the oval track finish on opposite straightaways when starting from the straight section.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Three-Parameter Model

The inherent discrepancy that results due to lane assignment may also be observed though the use of a three-parameter model of sprinting. This model may be used to simulate 200 m runs in different lanes. Changing one parameter value (constant but not maximal thrust force) allows simulation of 400 m runs in different lanes. This model derives from earlier models proposed in Joseph B. Keller, "A Theory of Competitive Running," Physics Today 26(9) pp. 42-47 (1973) ("Keller), and in Igor Alexandrov and Philip Lucht, "Physics of Sprinting," American Journal of Physics 49 pp. 254-257 (1981) ("Alexandrov and Lucht"), each of which is hereby incorporated by reference in its entirety. One of the parameters is the maximum thrust force that a runner can exert; this parameter also appears in Keller and Alexandrov and Lucht. The second parameter characterizes the resistive force on a runner, which is assumed to be proportional to the square of the speed; the assumption in Keller and Alexandrov and Lucht is that the resistive force is proportional to the speed itself. The third parameter is an "efficiency" coefficient that measures the runner's ability to provide maximum thrust force in exactly the right direction, while coping with the centrifugal effect on limbs and torso. There is no such term in Keller or Alexandrov and Lucht.

The analysis of sprinting is based on two equations of motion, one for a straight run and the other for a run on a curved track. The first equation is $$\frac{d^2x}{dt^2} = -\beta\left(\frac{dx}{dt}\right)^2 + F \tag{1}$$

and the second is $$\frac{d^2x}{dt^2} = \beta\kappa V^2\left\{1 - \frac{\left(\frac{dx}{dt}\right)^4}{(\beta V^2 R_n)^2}\right\}^{1/2} - \beta\left(\frac{dx}{dt}\right)^2 \tag{2}$$

These equations derive from earlier theories of Keller and Alexandrov and Lucht. The theories of Keller and Alexandrov and Lucht and their relationship to Eqs. (1) and (2) are explored further below. In Eqs. (1) and (2), x denotes distance and v=dx/dt denotes speed. V is the "terminal speed" on the straight, $R_n$ is the radius of the nth track lane and κ is an "efficiency" parameter (these three constants are discussed below).

The Thrust Force

The constant F is the maximum thrust force per unit mass; the definition of a sprint is that the maximum thrust is supplied throughout. This thrust force is generated by the runner pushing his or her feet against the track.

The Resistive Force

Figure 2:
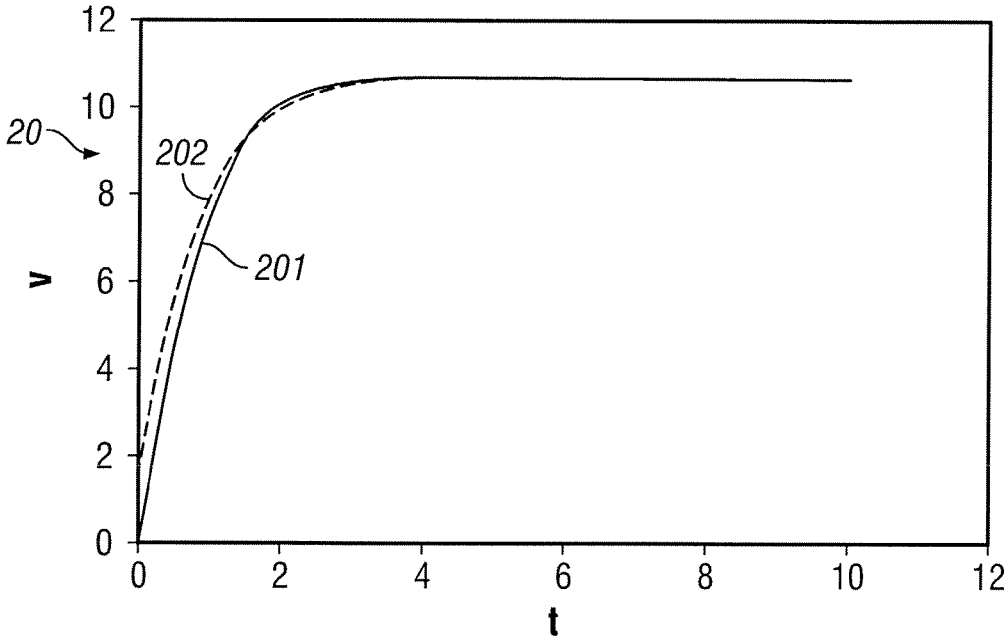
FIG. 2 illustrates the relationship between speed, V, and time, T.

The first term on the right in Eq. (1) is the resistive force per unit mass. Both Keller and Alexandrov and Lucht assumed that the resistive force is proportional to the speed ($-\alpha v$) rather than the squared speed ($-\beta v^2$) as in Eqs. (1) and (2). It is not worthwhile to debate this issue here because this discussion is limited to the case of constant thrust force, for which linear and quadratic resistive force laws yield virtually identical results. FIG. 2 illustrates the relationship between speed, V, and time, T, as determined by Eq. 3 for line 201 and Eq. A3 (below) for dotted line 202. For lines 201 and 202 in graph 20, V=10.753 m/sec and α is related to β based on the relationship of Eq. A6 (below). Also of note with regard to resistive forces, while air resistance is certainly a factor, the resistive force is also primarily a ground force reaction. When the runner's foot hits the track, it is brought to rest instantaneously by a frictional ground reaction force, which is the primary resistive force. This is abundantly clear if one watches a runner who has crossed the finish line and no longer exerts a thrust force. He or she is brought to a stop, not by air resistance, but by a series of ground reaction impulses.

Terminal Speeds

The first integral of Eq. (1), with initial condition v(0)=0, i.e., starting from rest, is $$v = V\tanh\beta Vt; \quad V = \sqrt{\frac{F}{\beta}} \tag{3}$$

The speed increases rapidly and approaches the terminal speed V asymptotically (FIG. 2). The value of V in the second Eq. (3) may be found directly by setting dv/dt=0 in Eq. (1). The terminal speed $V_n$ for Lane n is found similarly by setting dv/dt=0 in Eq. (2). This leads to $$V_n = V\left\{\frac{1}{\kappa^2} + \frac{1}{(\beta R_n)^2}\right\}^{-1/4} \tag{4}$$

The Centrifugal Effect

Alexandrov and Lucht modeled the centrifugal effect on an athlete running a curved path. In addition to the acceleration dv/dt in the direction of motion, the runner experiences an acceleration component $v^2/R_n$ directed toward the center of curvature. The thrust force must support this acceleration, i.e., must oppose the centrifugal force, if the runner is to stay in his or her lane. Consequently, the thrust force must be directed at an angle θ to the direction of motion, such that $$F\sin\theta = \frac{v^2}{R_n} \tag{5}$$

Figure 3:
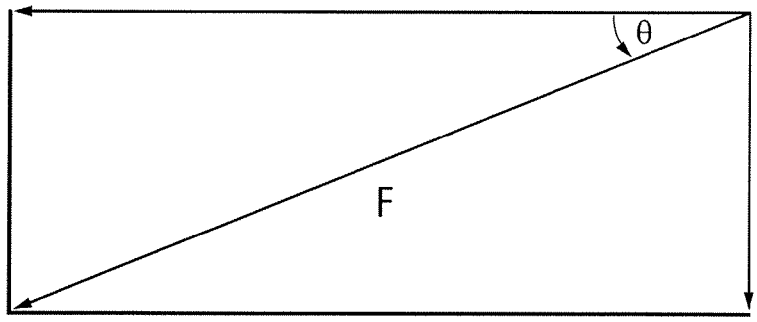
FIG. 3 illustrates the thrust force components in running a curve.

The thrust force component in the direction of motion is reduced to Fcosθ and substituting this for F in Eq. (1) leads to Eq. (2), with κ=1. FIG. 3 illustrates the thrust force components in running a curve as described herein.

The Radius of Curvature

Figure 1A:
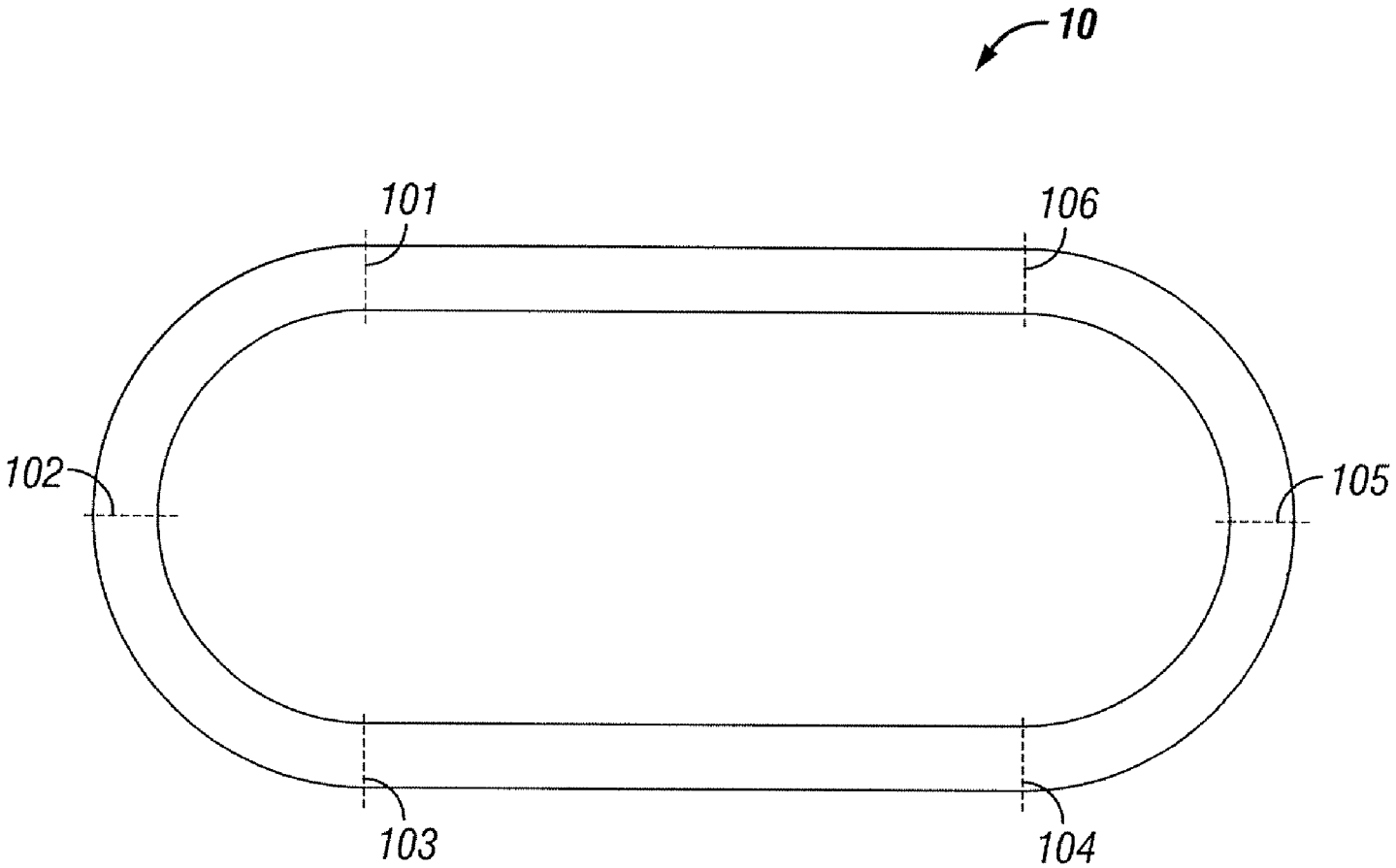
FIG. 1A (Prior Art)
FIG. 1A illustrates a track configuration according to the prior art.
Figure 1B:
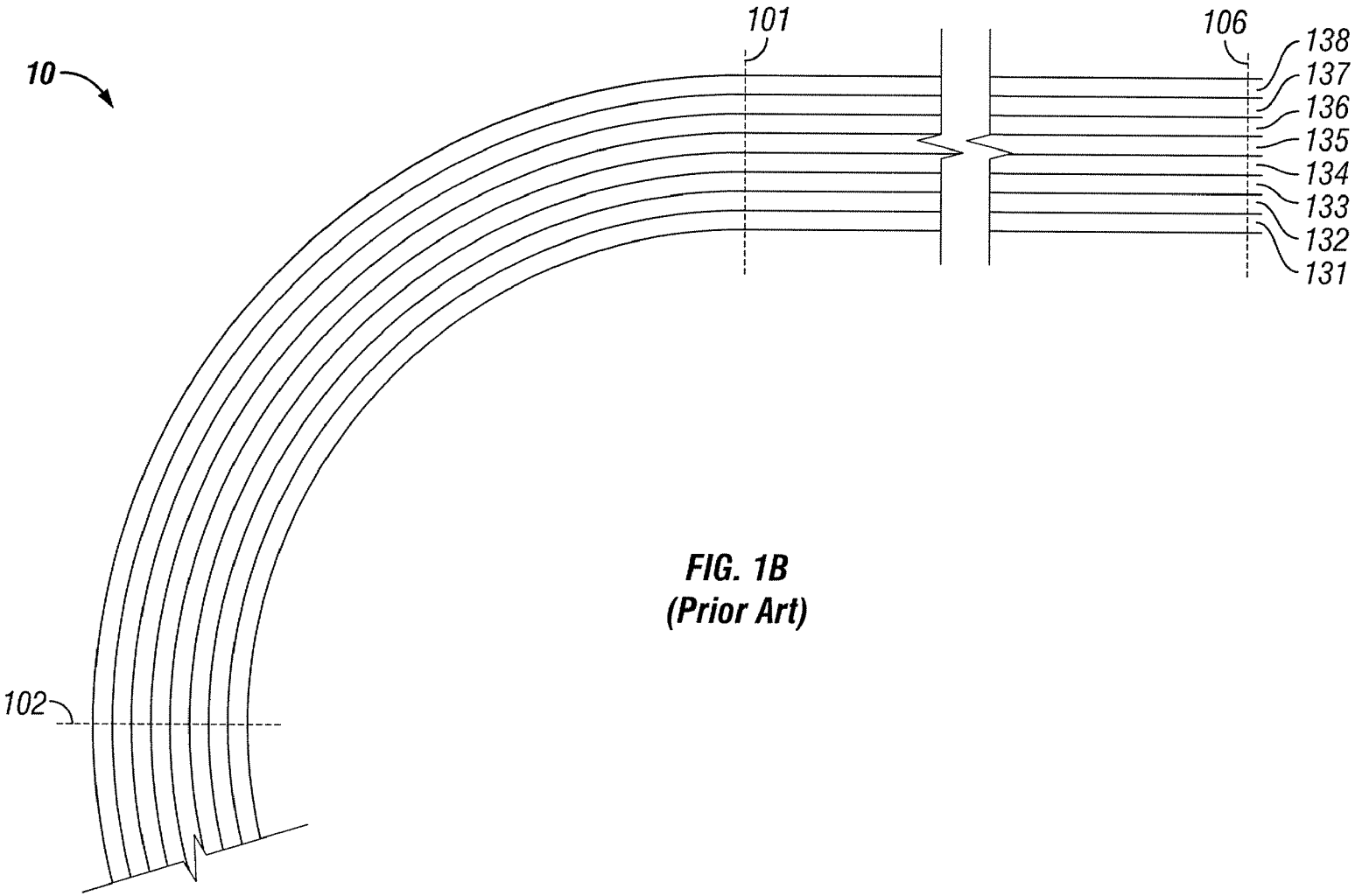
FIG. 1B (Prior Art)
FIG. 1B illustrates a close-up on a quadrant of the track configuration of FIG. 1A according to the prior art.

Each lane of a typical running track consists of two parallel straight 100 m segments, capped at each end by semi-circular arcs as shown in FIG. 1A. The inner boundary of the inner lane (Lane 1) illustrated as lane 131 in FIG. 1B has semi-circular arc length 100 m, so that $$R_1 = \frac{100\,\mathrm{m}}{\pi} \approx 31.83\,\mathrm{m} \tag{6a}$$

Or more generally, for a track with a semi-circular arc of length L $$R_1 = \frac{L}{\pi} \tag{6b}$$

Each lane has width 1.22 m, so that $$R_n = \{31.83 + 1.22(n-1)\}m \tag{7a}$$

Or more generally, for a track with a semi-circular arc length L and lanes of width W $$R_n = \left\{\frac{L}{\pi} + W(n-1)\right\}m \tag{7b}$$

System Parameter Values

Following Alexandrov and Lucht, measured world record times for the 100 m (10.1 sec) and straight 220 yards (19.51 sec) can be used to evaluate the system parameters β and F or, equivalently, β and V. It is assumed that the 220 yards time is equivalent to a time of 19.40 sec for 200 m. In view of the 100 m time, it may be assumed that the split times for the first and second halves of the 200 m were 10.1 sec and 9.30 sec, respectively. Since the second half was run at the terminal speed V, this gives the parameter value V=10.753 m $\mathrm{sec}^{-1}$. The first Eq. (3), with v=dx/dt, integrates to $$x = \frac{1}{\beta}\ln\cosh\beta Vt \tag{8}$$

For times T for which the exponential exp(−βVT) is negligible, this gives $$X \approx VT - \frac{1}{\beta}\ln 2 \tag{9}$$

so that $$\beta \approx \frac{\ln 2}{VT - X} \tag{10}$$

Substituting the measured 100 m time gives β=0.0805 $\mathrm{m}^{-1}$.

Efficiency

Alexandrov and Lucht used their (linear resistive force) versions of Eqs. (1) and (2) to predict a record time for the conventional (curved) 200 m. Their predicted time of 19.68 sec compared to the measured time of 19.83 sec represents an under-estimation of the centrifugal effect; the difference between the measured straight and curved track times is 0.43 sec but their predicted difference is only 0.28 sec. Not surprisingly (see below), use of Eqs. (1) and (2), with κ=1, also predicts a difference of only 0.26 sec.

Since this discrepancy between the theoretical prediction and the measured time for the conventional 200 m run does not stem from the assumed form of the resistive force, it must be associated with the thrust force Fcosθ. It is evident from Eq. (5) that the values of F, v and $R_n$ determine the angle θ. If, for example, the runner provides a maximum thrust force F at too great an angle to the direction of motion at one particular step, then he or she must correct for this during subsequent steps, in order to stay in lane. Furthermore, he or she must do this while controlling limbs, torso and head that are also experiencing centrifugal force. It would be very surprising if the runner could manage this perfectly by providing maximum thrust force F at exactly the correct angle θ at each step. The parameter κ(0<κ<1) is a measure of how well the runner does this. In fact, it is a measure of relative efficiency, i.e., of how well the runner manages running the curve compared to running the straight (providing maximum thrust force at angle θ=0). Equation (1) represents the limit of Eq. (2) as $R_n \to \infty$, provided κ→1. While one would expect the efficiency parameter κ to depend on the curvature, it is convenient to assume that it is effectively constant over the limited range of radii $R_1$ to $R_8$.

Simulations

Equations (1) and (2) were used to simulate a conventional 200 m run in Lane 3 and iterated to find the value of κ that would give the measured world record time. This led to the realistic value κ=0.963, which represents a 3.7% drop in efficiency. A 4×100 m relay runner is often assigned to run a particular leg because he or she "runs the curve well." This runner would be characterized by an unusually high value of κ.

Having identified three parameter values that reproduce the three measured world records times, namely $$V = 10.753\ \mathrm{m\ sec}^{-1};\ \beta = 0.0805\ \mathrm{m}^{-1}\ \kappa = 0.963 \tag{11}$$

conventional 200 m runs in each of the eight lanes can be simulated. Simulation of the 400 m runs requires a modification, because the 400 m is not a sprint, i.e., a runner cannot sustain maximum thrust force F for 400 m. A more realistic assumption is that he or she can sustain a constant reduced thrust force γF and comparison of predicted times with current world record times suggest a reduction of approximately 20% (γ=0.8). This corresponds to a $\sqrt{\gamma}$ reduction in speed. A useful scaling property of Eqs. (1) and (2) implies that the time for a 400 m run in any lane may be found by first treating the race as a sprint and then dividing the calculated race time by $\sqrt{\gamma}$.

Substituting these parameter values in Eqs. (1) and (2) leads to $$\frac{d^2x}{dt^2} = 0.0805\left\{115.63 - \left(\frac{dx}{dt}\right)^2\right\} \tag{12}$$

and

-continued $$\frac{d^2x}{dt^2} = 8.9636\left\{1 - \frac{\left(\frac{dx}{dt}\right)^4}{(9.3080R_n)^2}\right\}1/2 - 0.0805\left(\frac{dx}{dt}\right)^2 \tag{13}$$

Even though Eq. (12) can be integrated in closed form (see Eq. (8)), it is convenient to integrate both equations numerically, using Mathematica NDSolve using the following procedure:

1. Substitute the appropriate value of $R_n$ from Eq. (7) in Eq. (13).
2. Solve Eq. (13), with initial conditions $$x(0) = 0; \quad \frac{dx}{dt}(0) = 0 \tag{14}$$

to find the time at which x=100 m and the speed at that time. (This will be the terminal speed $V_n$.)

3. Solve Eq. (12), with initial conditions $$x(0) = 0; \quad \frac{dx}{dt}(0) = V_n \tag{15}$$

to find the time at which x=100 m. The speed at that time will be V.

4. The sum of these two times is the 200 m time.
5. Solve Eq. (13), with initial conditions $$x(0) = 0; \quad \frac{dx}{dt}(0) = V \tag{16}$$

to find the time at which x=100 m.

6. The time for the fourth 100 m will be the same as that for the second.
7. The sum of these four times is the 400 m sprint time.
8. Divide by $\sqrt{\gamma}$ (multiply by 1.12) to get the 400 m time.

The results of these calculations (in seconds) are listed as $T_{conv}$ (for the 200 m) and $T^*_{conv}$ (for the 400 m) in Table 1.

TABLE 1

| Lane | $T_{conv}$ | $T^*_{conv}$ | $T_{conv}$ | $T^*_{prop}$ |
|---|---|---|---|---|
| 1 | 19.87 | 43.66 | 19.64 | 43.39 |
| 2 | 19.85 | 43.60 | 19.63 | 43.38 |
| 3 | 19.83 | 43.56 | 19.63 | 43.37 |
| 4 | 19.82 | 43.53 | 19.63 | 43.37 |
| 5 | 19.80 | 43.49 | 19.63 | 43.36 |
| 6 | 19.79 | 43.46 | 19.63 | 43.36 |
| 7 | 19.78 | 43.43 | 19.63 | 43.35 |
| 8 | 19.76 | 43.40 | 19.62 | 43.35 |
| Δ | 0.11 | 0.26 | 0.01 | 0.04 |

An additional row, labeled Δ, is included listing the differences between times for Lane 1 and Lane 8, because simply subtracting the listed times may lead to round-off errors.

These calculations may be repeated without the efficiency factor, i.e., setting κ=1 in Eq. (2). This led to the decrease of 0.15 sec below the measured Lane 3 record time, mentioned above, and to the same decrease below the calculated times $T_{conv}$ for all lanes. So, omission of the efficiency factor did not change the predicted discrepancies between times for the various lanes. If the 400 m is modeled as a sprint (setting γ=1), then the race times are reduced significantly. However, the change in the predicted discrepancy between lane 1 and lane 8 is reduced from 0.26 sec to 0.23 sec, for the conventional 400 m, and is unchanged for the proposed 400 m.

The Theories of Keller and Alexandrov and Lucht

The counterparts of Eqs. (1) and (2) in the theories of Keller and Alexandrov and Lucht are $$\frac{dv}{dt} = a(V - v); \quad V = \frac{F}{a} \tag{A1}$$

and $$\frac{dv}{dt} = aV\left\{1 - \frac{v^4}{R_n^2}\right\}^{1/2} - av \tag{A2}$$

Integration of the first Eq. (A1), with initial condition v(0)=0, gives $$v = V(1 - e^{-\alpha t}) \tag{A3}$$

A second integration, with x(0)=0 and assuming that the time T is such that the exponential term is negligible, gives the counterpart of Eq. (9) as $$X \approx V\left(T - \frac{1}{\alpha}\right) \tag{A4}$$

Setting dv/dt=0 in Eq. (A2) gives Vn as the root of a quadratic equation $$v_n^2 = \frac{1}{2}\alpha^2 R_n^2\left[\left\{1 + \left(\frac{2V}{\alpha R_n}\right)^2\right\}^{1/2} - 1\right] \tag{A5}$$

We can now compare this theory with that presented in Section 2, without the efficiency factor (κ=1). If the predictions of the two theories for straight runs are to agree, then the two terminal speeds (V) must be the same. If the asymptotic distance is also to be the same for both theories, then comparing Eqs. (9) and (A4) gives $$\alpha = \frac{\beta V}{\ln 2} \tag{A6}$$

The speed versus time curves from Eqs. (3) and (A3), with parameter values from Eqs. (11) and (A6) are shown in FIG. 2 and they agree very well. While the formulae in Eqs. (4) and (A5) are different, they also show very good agreement. For example, the terminal speeds for Lane 1 are 10.4066 m $sec^{-1}$, from Eq. (4), and 10.4026 m $sec^{-1}$, from Eq. (A5).

Thus the predictions of the two theories (linear and quadratic resistive force laws), without the efficiency factor and specialized to constant thrust force, are virtually identical. It can be shown that the same is true for other realistic forms of the resistive force law.

New Track Configuration

Differences of 0.11 sec or 0.26 sec between the times of equally good athletes running in lanes with different curvatures are quite bothersome, since 200 m and 400 m races are often decided by much smaller margins. Thus, a new track configuration for these races is designed to reduce or eradicate these differences. The underlying principle is that competitors in different lanes, instead of running equal arc lengths on the curves, as they do in the present system, will run equal arc angles. As will be seem below, the modification consists of a reconfiguration of the track shape as well as a new formula for determining staggered starting positions.

Figure 1C:
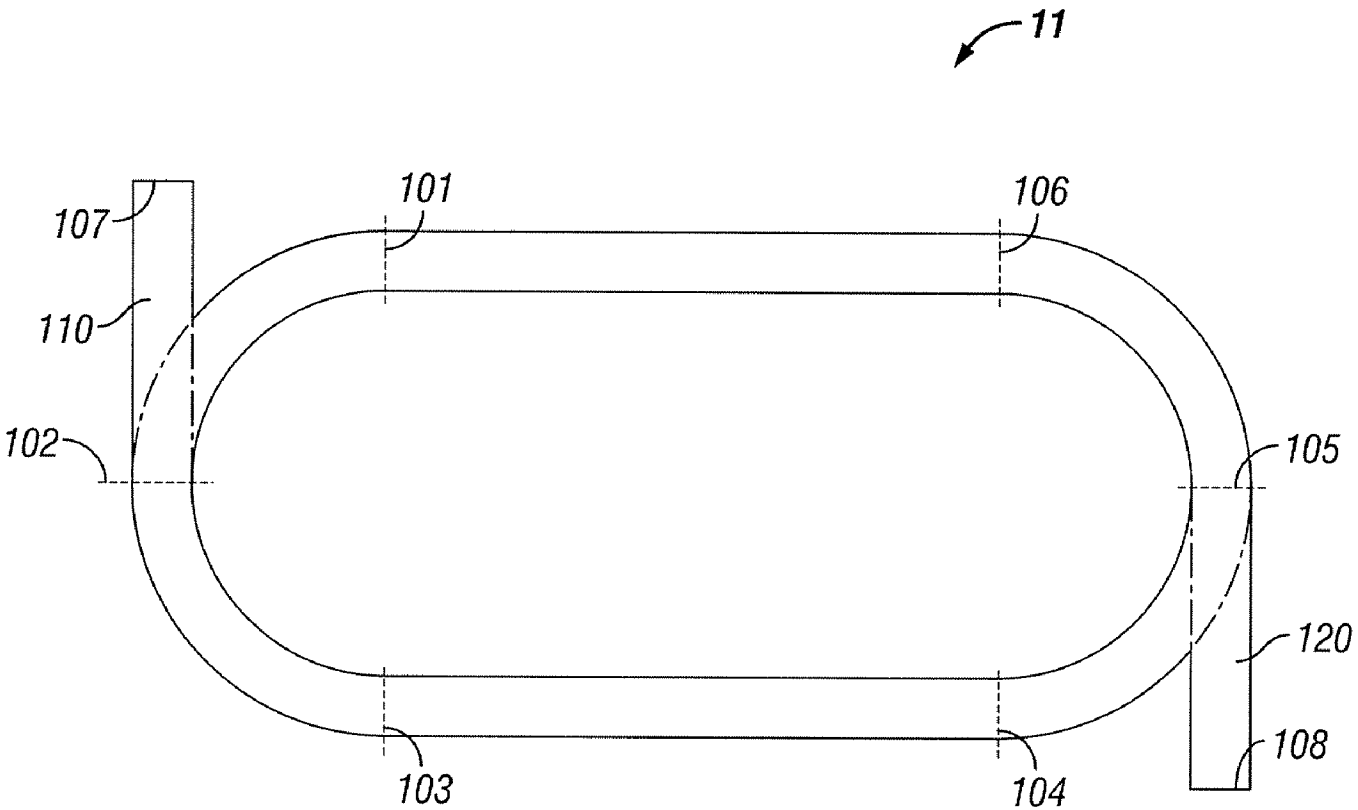
FIG. 1C illustrates a track configuration according to one embodiment of the present invention.
Figure 1D:
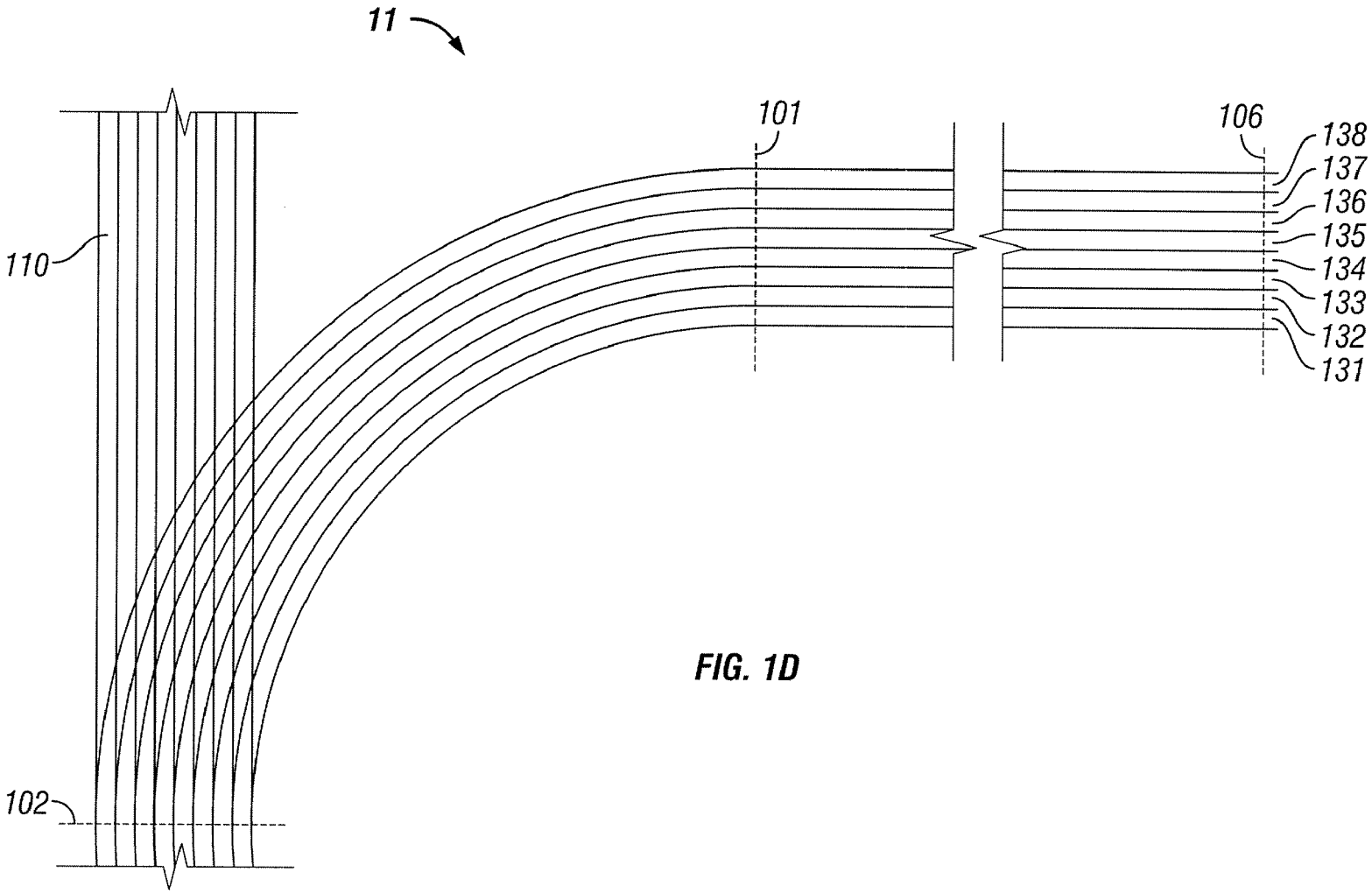
FIG. 1D illustrates a close-up on a quadrant of the track configuration of FIG. 1C according one embodiment of the present invention.
Figure 1E:
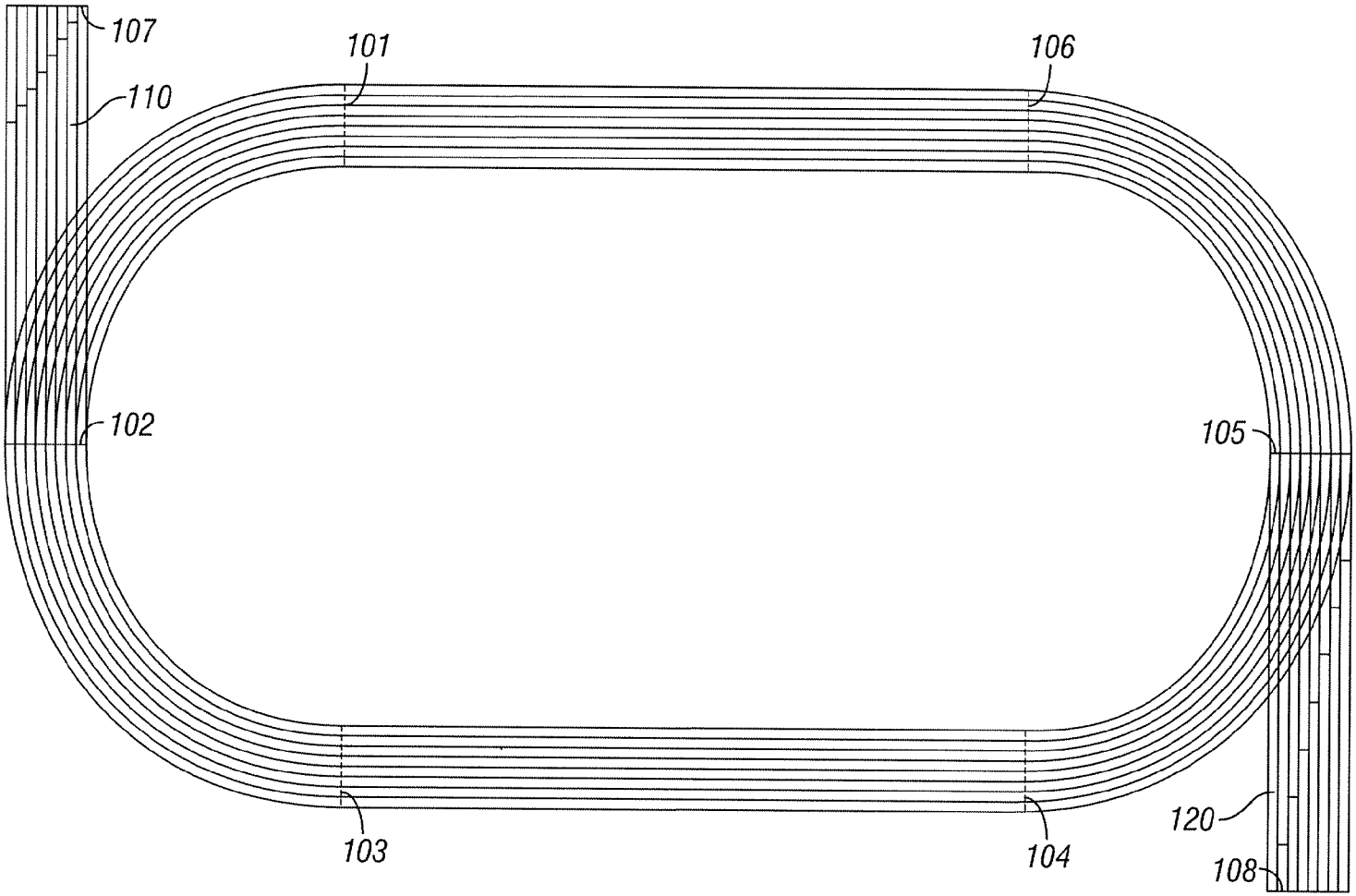
FIG. 1E illustrates a track configuration according to one embodiment of the present invention.

The proposed track design according to one embodiment of the invention is shown in FIGS. 1C-1E. The track configuration features straight segments 110 and 120 extending from points 102 and 105, respectively. The straight segments 110 and 120 have a length of half of the curved semi-circular section to which they attach, or 50 m for a standard 400 m track in one embodiment. These straight segments extend away from track 11 in opposite directions, both perpendicular to the existing straightaways. As is shown in FIG. 1D, straight segment 110 includes lane markers that merge with the existing lane markers of track 11 at point 102 (segment 120, not shown, includes identical markings). If adopted, the new segments 110 and 120 would not affect other track or field events. These segments would be easily accommodated in construction of a new stadium and it would be a fairly straightforward renovation of an existing stadium, provided space is available. Segment 110 protrudes a distance 8.41 m beyond the outer edge of the track extending from point 106 to 101. Segments 110 and 120 may be designed to terminate in a rectangular shape such as is illustrated in FIG. 1C or may be angled to accommodate the staggered starting positions such that the straight section extends further at lane 1 than at the outer lane. Such an angled configuration may prove advantageous in a tight space.

Under the proposed scheme, each athlete runs the same arc angle—a quadrant of a circle in the 200 m and a quadrant and a semi-circle in the 400 m. The offsetting effect is that runners in the less curved outer lanes, for whom the centrifugal effect is less severe, are required to run longer arc lengths. The model calculations predict that the proposed modification achieves almost complete parity for the 200 m and reduces the "Lane 8 advantage" from 0.26 sec to 0.04 sec. for the 400 m. Adoption of the proposed redesign would result in lower records, especially in 200 m events. Calculated times for Lane 4, for example, in Table 1 predict a 0.19 sec reduction in the 200 m and a 0.16 sec reduction in the 400 m.

It is rather curious, as pointed out by Alexandrov and Lucht, that Lane 8 is not the preferred lane assignment, even though the mechanics indicates that it should be. Runners seem to feel that not being able to see one's competitors during the early stages of a race, due to the staggered start, is disadvantageous. This is psychological (motivational) rather than strategic in events where the only strategy is to run flat out. Interestingly, in indoor track, where the curves are tighter and the centrifugal effect is correspondingly more severe, the outer lanes 5 and 6 are the preferred lanes.

200 m Race Track Configuration

Turning to FIG. 1C, for a 200 m race, the runner in Lane 1, instead of running a 100 m semi-circular arc from point 101 to 102 to 103 followed by a straight 100 m from point 103 to 104, will run a straight 50 m on segment 110 from point 107 to 102 followed by a 50 m circular quadrant from point 102 to 103 and a straight 100 m from point 103 to 104. Each of the other runners will also run a straight segment of length $100-\pi R_n/2$ m followed by a circular quadrant of length $\pi R_n/2$ and a straight 100 m. This means that the nth stagger distance is $\pi R_n/2-50$ m. Such a configuration allows each competitor to run equal arc angles since the staggered starting position are on a straight portion while still utilizing the common finish line at point 104.

It follows from Eqs. (6) and (7) that the various segments lengths (in meters) are as listed in Table 2.

TABLE 2

| Lane | Straight | Curved | Straight |
|---|---|---|---|
| 1 | 50 | 50 | 100 |
| 2 | 48.08 | 51.92 | 100 |
| 3 | 46.17 | 53.83 | 100 |
| 4 | 44.25 | 55.75 | 100 |
| 5 | 42.33 | 57.67 | 100 |
| 6 | 40.42 | 59.58 | 100 |
| 7 | 38.50 | 61.50 | 100 |
| 8 | 36.58 | 63.42 | 100 |

Times for this new 200 m run are calculated from Eqs. (12) and (13) as before and the results ($T_{prop}$) are listed in Table 1. Two aspects are especially noteworthy. The first is that the new design almost completely eradicates the discrepancies between the times for the various lanes. The second is that the times for all eight lanes are lower than those for the present 200 m run ($T_{conv}$). This is obviously because all eight runners will run less than 100 m on the curve.

For a runner in Lane 1, the conventional 200 m requires running a 100 m semi-circle and the proposed 200 m requires running a 50 m circular quadrant. So, in a certain sense, the proposed run is halfway between the conventional run and a straight run. This is reflected in the calculated times for the conventional run (19.87 sec) and the proposed run (19.64 sec) and the measured time for the straight run (19.40 sec).

400 m Race Track Configuation

Turning to a 400 m race, a runner in Lane 1, instead of running a 100 m semi-circle from point 104 to 105 to 106, a straight 100 m from point 106 to 101, another 100 m semi-circle point 101 to 102 to 103 and another straight 100 m from point 103 to 104, the runner in Lane 1 will run a straight 50 m on segment 120 from point 108 to 105, then a 50 m quadrant from point 105 to 106, a straight 100 m from point 106 to 101, a 100 m semi-circle from point 101 to 102 to 103 and another straight 100 m from point 103 to 104. Additionally, if having the 200 m and 400 m events finish on opposite sides of the track is acceptable (from the spectators' standpoint), then only one additional feature is necessary (i.e., only segment 110 and not segment 120 need be added). For example, the Lane 1 runner in the 400 m could run the course from point 107 to 102 to 103 to 104 to 105 to 106 to 101. In the old configuration, each of the other runners begins with a circular arc that is greater than a quadrant and less than a semi-circle, then runs a straight 100 m, then a semi-circular arc and another straight 100 m. In the configuration of the present embodiment, each of the other runners will begin with a straight segment, then run a quadrant, straight 100 m, a semi-circle and another straight 100 m. The segment lengths, in order, are $200-3\pi R_n/2$, $\pi R_n/2$, 100, $\pi R_n$, 100 m. The nth stagger distance is $3\pi R_n/2-150$ m. Such a configuration allows each competitor to run equal arc angles since the staggered starting positions are on a straight portion while still utilizing the common finish line at point 104.

The various segments lengths (in meters) are listed in Table 3.

TABLE 3

| Lane | Straight | Curved | Straight | Curve | Straight |
|---|---|---|---|---|---|
| 1 | 50 | 50 | 100 | 100 | 100 |
| 2 | 44.25 | 51.92 | 100 | 103.83 | 100 |
| 3 | 38.50 | 53.83 | 100 | 107.67 | 100 |
| 4 | 32.75 | 55.75 | 100 | 111.50 | 100 |
| 5 | 27.00 | 57.67 | 100 | 115.33 | 100 |
| 6 | 21.25 | 59.58 | 100 | 119.17 | 100 |
| 7 | 15.50 | 61.50 | 100 | 123.00 | 100 |
| 8 | 9.75 | 63.42 | 100 | 126.83 | 100 |

With Table 3 and Eqs. (6) and (7), the equations of motion (12) and (13) may be integrated, as before, to get times for the various lanes for the proposed 400 m run. These times ($T_{prop}$) are given in Table 1. Notice that the discrepancies between times for the various lanes are greatly reduced ($\Delta$=0.04 sec). The times for all lanes are reduced because all eight runners runs less than 200 m on the curve. For a runner in Lane 8, the conventional and proposed 400 m runs are almost the same (FIG. 1) and this is reflected in the calculated times, which differ by 0.04 sec.

FIG. 1E illustrates a configuration of track 11 according to a preferred embodiment. Straight section 110 is marked with the staggered starting positions listed in Table 2 for a 200 m race finishing at point 104 and straight section 120 is marked with the staggered s listed in Table 3 for a 400 m race also finishing at point 104. It should also be noted that the new track configuration illustrated in FIG. 1E requires minimal modification of other track markings. The location of hurdles for the 400 m hurdles does not change except for the first hurdle in lane 1 and the locations of the exchange spots for the 4×100 m relay remain the same. Additionally, for both the 200 m and the 400 m race, the splits between the staggered starting positions are reduced as compared to the traditional 200 m and 400 m races respectively.

In another embodiment, straight sections 110 and 120 are not utilized; rather, runners run equal arc angles by starting at staggered starting positions along a straightaway section. Such a configuration would result in slower times than the traditional configuration as runners would run an entire semicircular curved portion in a 200 m race. Further, such a configuration would require new hurdle and relay exchange locations and would not allow the 200 m and 400 m races to share a common finish line.

A Simpler Analysis

The running times listed in Table 1 were calculated by solving the nonlinear ordinary differential equations (12) and (13) numerically. An alternative simpler analysis approximates these results very well.

To begin, recall Eq. (9):

$$X \approx VT - \frac{1}{\beta}\ln 2 \tag{9}$$

Since the first term on the right represents the distance run in time T at constant speed V, the second term is the correction for the initial acceleration phase as can be seen in graph 20 in FIG. 2. The treatment of a race may be simplified by adopting the approximation Eq. (9) for the first segment and by assuming the every subsequent segment is run at constant speed V, on the straight, or $V_n$, on the curve. Thus, the continuous accelerations and decelerations as the runner's speed changes from $V_n$ to V and back may be ignored, assuming instead that these changes occur instantaneously. Then the time $T_n$ for a race over a distance L run in Lane n is given by $$T_n = \frac{L - L_n}{V} + \frac{L_n}{V_n} + \frac{\ln 2}{\beta V} \tag{17}$$

if the race begins with a straight segment, and by $$T_n = \frac{L - L_n}{V} + \frac{L_n}{V_n} + \frac{\ln 2}{\beta V_n} \tag{18}$$

if it begins on a curve.

Introducing the dimensionless parameters $\lambda_n$ and $\Psi_n$ defined as $$\lambda_n = \frac{L_n}{L};\quad \Psi_n = \frac{V}{V_n} \tag{19}$$

leads to $$T_n = \frac{L}{V}\{1 + \lambda_n(\Psi_n - 1)\} + \frac{\ln 2}{\beta V} \tag{20}$$

or its counterpart from Eq. (18). Notice that the curved length fraction $\lambda_n$ has the value ½ for all lanes in the conventional 200 m and 400 m, so that Eq. (20) reduces to $$T_n = \frac{L}{2V}(\Psi_n + 1) + \frac{\ln 2}{\beta V} \tag{21}$$

Equation (20) provides some insight as to why the proposed redesign eradicates the centrifugal effect. The key term is $\lambda_n(\Psi_n-1)$. Since $\Psi_n$ is inversely proportional to $V_n$, it decreases as the lane number n increases from 1 to 8. For conventional 200 m and 400 m races, the curved length fraction $\lambda_n$ is constant. Thus, there is no offsetting effect and so the time $T_n$ also decreases as n goes from 1 to 8. For the proposed new 200 m and 400 m runs, however, the curved length fraction $\lambda_n$ increases as n goes from 1 to 8. Fortuitously, this increase almost exactly offsets the decrease in $\Psi_n-1$, so that values of $\lambda_n(\Psi_n-1)$, listed in Table 4, are almost constant.

TABLE 4

| Lane 1 | Lane 2 | Lane 3 | Lane 4 | Lane 5 | Lane 6 | Lane 7 | Lane 8 |
|---|---|---|---|---|---|---|---|
| 0.0130 | 0.0129 | 0.0128 | 0.0127 | 0.0126 | 0.0125 | 0.0125 | 0.0125 |

These differences in the fourth decimal place have virtually no effect, even when multiplied by LN.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A track configuration having a plurality of portions, each portion having a plurality of lanes numbered 1 through n where lane 1 is the innermost lane, said track configuration comprising:

a first straightaway portion;

a second straightaway portion arranged parallel to said first straightaway portion;

a first curved portion extending from a first end of said first straightaway portion to a first end of said second straightaway portion;

a second curved portion extending from a second end of said first straightaway portion to a second end of said second straightaway portion;

a straight portion arranged perpendicular to said first and second straightaway portions extending from a midpoint in said first curved portion equidistant from said first end of said first straightaway and said first end of said second straightaway away from the side of the track configuration having said first straightaway portion; and a plurality of starting position markers positioned on said straight portion such that each of said plurality of lanes has a starting position marker and the length from the starting position marker in each lane to a single finish line on said first straightaway portion is equal.

2. The track configuration of claim 1 wherein:

the total distance of lane 1 around said first curved portion, first straightaway, second curved portion and second straightaway is 400 m; and for said plurality of starting position markers, the nth stagger distance is $\pi R_n/2-50$ m.

3. The track configuration of claim 1 wherein:

said straight portion extends from said midpoint in said first curved portion equidistant from said first end of said first straightaway and said first end of said second straightaway a distance sufficient to accommodate said plurality of starting position markers such that said straight portion in lane 1 extends further from said midpoint than said straight portion in lane n.

4. The track configuration of claim 1 comprising:

a plurality of starting position markers positioned on said straight portion such that each of said plurality of lanes has a starting position marker and the length from the starting position marker in each lane to a single finish line on said second straightaway portion is equal.

5. The track configuration of claim 4 wherein:

the total distance of lane 1 around said first curved portion, first straightaway, second curved portion and second straightaway is 400 m; and for said plurality of starting position markers, the nth stagger distance is $3\pi R_n/2-150$ m.

6. The track configuration of claim 4 wherein:

said straight portion extends from said midpoint in said first curved portion equidistant from said first end of said first straightaway and said first end of said second straightaway a distance sufficient to accommodate said plurality of starting position markers such that said straight portion in lane 1 extends further from said midpoint than said straight portion in lane n.

7. The track configuration of claim 1 comprising:

a second straight portion arranged perpendicular to said first and second straightaway portions extending from a midpoint in said second curved portion equidistant from said first end of said first straightaway and said first end of said second straightaway away from the side of the track configuration having said second straightaway portion.

8. The track configuration of claim 7 comprising:

a plurality of starting position markers positioned on said second straight portion such that each of said plurality of lanes has a starting position marker and the length from the starting position marker in each lane to a single finish line on said first straightaway portion is equal.

9. The track configuration of claim 8 wherein:

the total distance of lane 1 around said first curved portion, first straightaway, second curved portion and second straightaway is 400 m;

for said plurality of starting position markers positioned on said straight portion, the nth stagger distance is $\pi R_n/2-50$ m; and for said plurality of starting position markers positioned on said second straight portion, the nth stagger distance is $3\pi R_n/2-150$ m.

10. A method for configuring a racing surface, said racing surface having a plurality of portions, each portion having a plurality of lanes numbered 1 through n where lane 1 is the innermost lane, comprising the steps of;

providing a first straightaway portion; providing a second straightaway portion arranged parallel to said first straightaway portion;

providing a first curved portion extending from a first end of said first straightaway portion to a first end of said second straightaway portion;

providing a second curved portion extending from a second end of said first straightaway portion to a second end of said second straightaway portion;

providing a straight portion arranged perpendicular to said first and second straightaway portions extending from a midpoint in said first curved portion equidistant from said first end of said first straightaway and said first end of said second straightaway away from the side of the track configuration having said first straightaway portion; and positioning a plurality of starting position markers on said straight portion such that each of said plurality of lanes has a starting position marker and the length from the starting position marker in each lane to a single finish line on said first straightaway portion is equal.

11. The method of claim 10 wherein the total distance of lane 1 around said first curved portion, first straightaway, second curved portion and second straightaway is 400 m, said method comprising:

positioning said plurality of starting position markers such that the nth stagger distance is $\pi R_n/2-50$ m.

12. The method of claim 10 comprising:

shaping said straight portion such that said straight portion extends from said midpoint in said first curved portion equidistant from said first end of said first straightaway and said first end of said second straightaway a distance sufficient to accommodate said plurality of starting position markers such that said straight portion in lane 1 extends further from said midpoint than said straight portion in lane n.

13. The method of claim 10 comprising:

positioning a plurality of starting position markers on said straight portion such that each of said plurality of lanes has a starting position marker and the length from the starting position marker in each lane to a single finish line on said second straightaway portion is equal.

14. The method of claim 13 wherein the total distance of lane 1 around said first curved portion, first straightaway, second curved portion and second straightaway is 400 m, said method comprising:

positioning said plurality of starting position markers such that the nth stagger distance is $3\pi R_n/2-150$ m.

15. The method of claim 13 comprising:

shaping said straight portion such that said straight portion extends from said midpoint in said first curved portion equidistant from said first end of said first straightaway and said first end of said second straightaway a distance sufficient to accommodate said plurality of starting position markers such that said straight portion in lane 1 extends further from said midpoint than said straight portion in lane n.

16. The method of claim 10 comprising:

providing a second straight portion arranged perpendicular to said first and second straightaway portions extending from a midpoint in said second curved portion equidistant from said first end of said first straightaway and said first end of said second straightaway away from the side of the track configuration having said second straightaway portion.

17. The method of claim 16 comprising:

positioning a plurality of starting position markers on said second straight portion such that each of said plurality of lanes has a starting position marker and the length from the starting position marker in each lane to a single finish line on said first straightaway portion is equal.

18. The method of claim 17 wherein the total distance of lane 1 around said first curved portion, first straightaway, second curved portion and second straightaway is 400 m, said method comprising:

positioning said plurality of starting position markers positioned on said straight portion such that the nth stagger distance is $\pi R_n/2-50$ m; and positioning said plurality of starting position markers positioned on said second straight portion such that the nth stagger distance is $3\pi R_n/2-150$ m.

19. A method for using a track comprising a first straightaway portion, a second straightaway portion arranged parallel to said first straightaway portion, a first curved portion extending from a first end of said first straightaway portion to a first end of said second straightaway portion, a second curved portion extending from a second end of said first straightaway portion to a second end of said second straightaway portion, a straight portion arranged perpendicular to said first and second straightaway portions extending from a midpoint in said first curved portion equidistant from said first end of said first straightaway and said first end of said second straightaway away from the side of the track configuration having said first straightaway portion, each portion having a plurality of lanes numbered 1 through n where lane 1 is the innermost lane, said method comprising:

positioning a plurality of starting position markers on said straight portion such that each of said plurality of lanes has a starting position marker and the length from the starting position marker in each lane to a single finish line on said first straightaway portion is equal.

20. The method of claim 19 comprising:

positioning said plurality of starting position markers positioned on said straight portion such that the nth stagger distance is $\pi R_n/2-50$ m.

21. The method of claim 19, said track further comprising a second straight portion arranged perpendicular to said first and second straightaway portions extending from a midpoint in said second curved portion equidistant from said first end of said first straightaway and said first end of said second straightaway away from the side of the track configuration having said second straightaway portion, said method comprising:

positioning a plurality of starting position markers on said second straight portion such that each of said plurality of lanes has a starting position marker and the length from the starting position marker in each lane to a single finish line on said first straightaway portion is equal.

22. The method of claim 21 comprising:

positioning said plurality of starting position markers positioned on said straight portion such that the nth stagger distance is $\pi R_n/2-50$ m; and positioning said plurality of starting position markers positioned on said second straight portion such that the nth stagger distance is $3\pi R_n/2-150$ m.

* * * * *